US005490334A

United States Patent [19]

Payne

[11] Patent Number: 5,490,334

[45] Date of Patent: Feb. 13, 1996

[54] SPEED HAND TOOL FOR STUDS, JOISTS, RAFTERS, AND THE LIKE

[75] Inventor: Douglas Payne, Groton Heights, Vt.

[73] Assignee: Frame Master, Inc., Wells River, Vt.

[21] Appl. No.: 350,581

[22] Filed: Dec. 6, 1994

Related U.S. Application Data

[63] Continuation of Ser. No. 967,802, Oct. 27, 1992, abandoned, which is a continuation-in-part of Ser. No. 846,384, Mar. 5, 1992, abandoned.

[51] Int. Cl.[6] ..... G01D 21/00

[52] U.S. Cl. ..... 33/613; 33/501; 269/904

[58] Field of Search ..... 33/613, 562, 334, 33/651.1, 338, 501; 269/43, 54, 904, 910; D8/88, 89, 105; 7/166, 122, 170; 254/133 R, 25, 18, 23, 21

[56] References Cited

U.S. PATENT DOCUMENTS

| | | | |
|---|---|---|---|
| 52,960 | 2/1866 | Nelson | 254/25 |
| 297,435 | 4/1884 | Nolan | 33/651.1 |
| 441,979 | 12/1890 | Rohrbach et al. | 7/166 |
| 1,242,210 | 10/1917 | Legon | 33/338 |
| 2,567,586 | 9/1951 | Werder | 33/562 |
| 2,686,959 | 8/1954 | Robinson | 33/613 |
| 2,744,334 | 5/1956 | Jondole | 33/613 |
| 2,896,910 | 7/1959 | Cooper et al. | 7/166 |
| 3,201,874 | 8/1965 | Christy | 33/613 |
| 4,237,614 | 12/1980 | Williams | 33/501 |
| 4,625,415 | 12/1986 | Diamontis | 33/613 |
| 4,843,726 | 7/1989 | Ward | 33/613 |
| 4,958,814 | 9/1990 | Johnson | 33/613 |
| 5,129,153 | 7/1992 | Burns, Sr. | 33/613 |

*Primary Examiner*—Thomas B. Will
*Attorney, Agent, or Firm*—Michael J. Weins

[57] ABSTRACT

A construction framing tool is provide by an elongated body member and a pair of cooperative members at its opposite ends for assembling studs, joists and rafters between headers and footers. The tool includes a holder or cradle as part of one cooperative member and a shoulder as part of the other cooperative member.

18 Claims, 3 Drawing Sheets

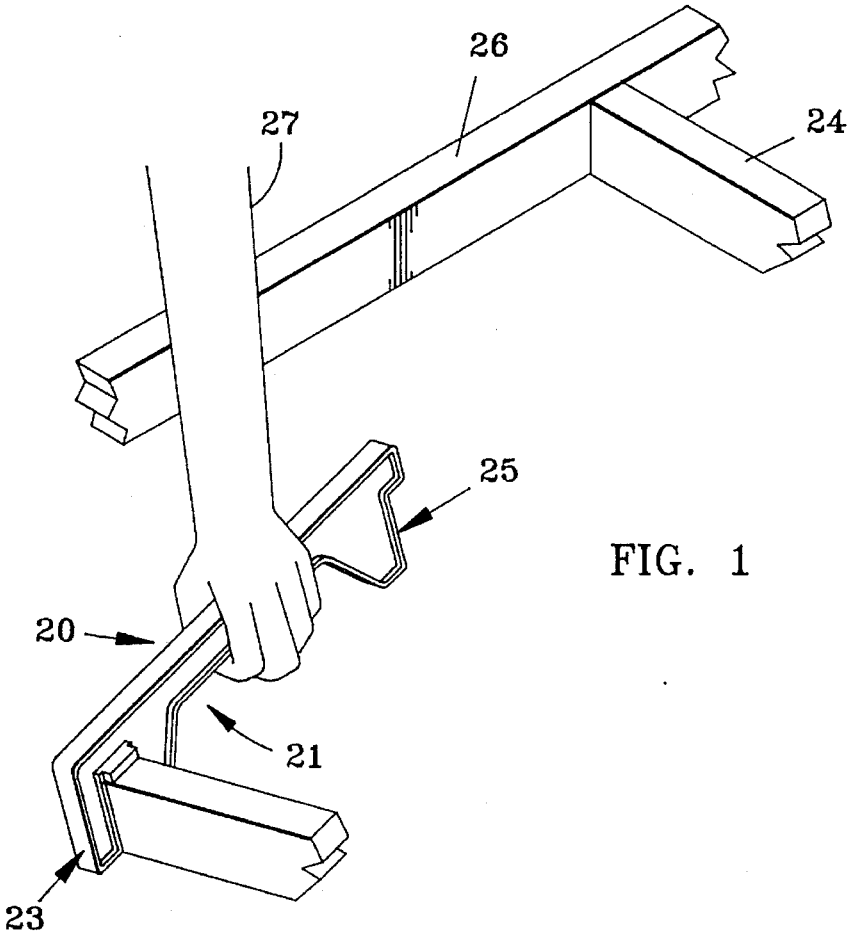
FIG. 1
FIG. 2
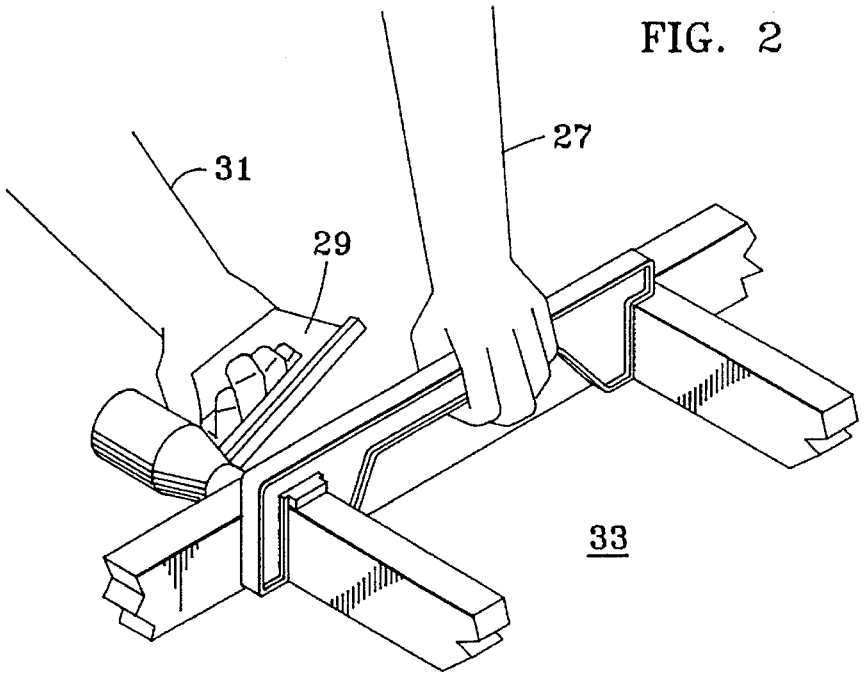

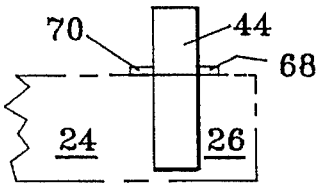
FIG. 6
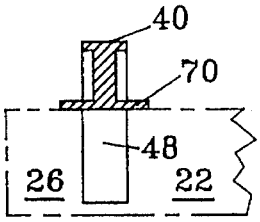
FIG. 7
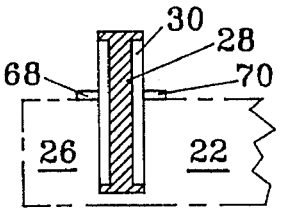
FIG. 8
FIG. 9
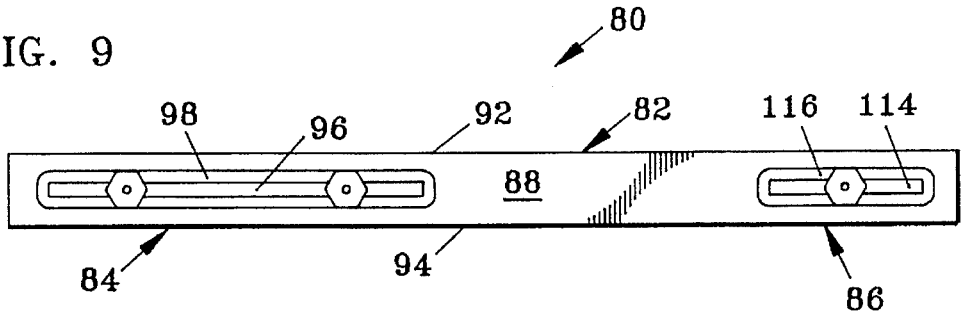
FIG. 10
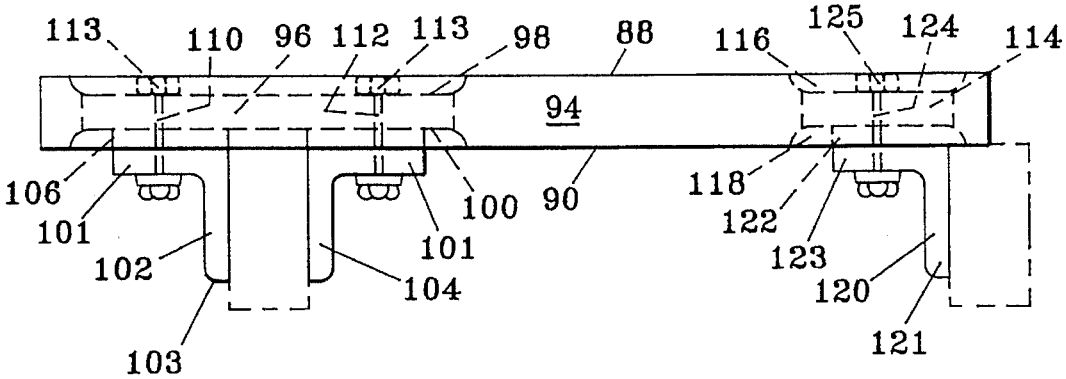

SPEED HAND TOOL FOR STUDS, JOISTS, RAFTERS, AND THE LIKE

This is a continuation of application(s) Ser. No. 07/967,802 filed on Oct. 27, 1992 now abandoned which was a continuation-in-part of U.S. patent application Ser. No. 07/846,384 filed on Mar. 5, 1992, now abandoned.

BACKGROUND OF THE INVENTION

1. Field of the Invention

The present invention relates to the installation of studs, joists, rafters and like orthogonal elements, that are disposed between headers, footers, plates and like traversal elements in a frame for a wall, roof, partition or the like in an architectural construction.

2. Background of the Invention

A variety of tools have been required during procedures for installing studs, joists, rafters and like orthogonal framing elements of standardized rectangular cross-section during the construction of walls, roofs, partitions and the like in a wide variety of public and private buildings. For convenience of explanation, these orthogonal framing elements often will be referred to herein simply as studs. Typically, these studs are arranged on a floor or other planar support while being assembled between footers, headers and like traversal elements into an initially horizontal frame assemblage, which, after being completed, is pivoted from and moved about the floor into an upright or oblique orientation for installation. These procedures typically have involved the use of various tools such as rules, squares, markers and the like. It is desired to ameliorate the difficulties inherent in selecting and manipulating such tools during these construction procedures, particularly while using such further required hand tools as hammers and nail-guns.

SUMMARY OF THE INVENTION

The present invention provides a construction framing tool comprising an elongated body member and a pair of cooperative members at its opposite ends for assembling studs, joists and rafters between headers and footers. Generally, all of these orthogonal and transversal elements are rectangular in cross section. The tool includes a holder or cradle as a part of one cooperative member and a shoulder as part of the other cooperative member. The cradle's mouth can be freely fitted about an uninstalled and loose stud only vertically from above the stud and possibly also endwise between the holder's jaws transversely with respect to the tool's axis of elongation. It will be appreciated that the cradle's mouth is not freely accessible to a stud along the tool's axis of elongation. The shoulder on the other hand is freely accessible to a fixed or set stud in all directions, including the tool's axis of elongation. Thus the cradle can be snugly fitted onto a loose stud for translation and orientation along a plane. Then the shoulder can be moved along the same plane and snugly fitted against a fixed stud to control the final position of the loose stud, which is being held by the cradle's jaws. Technically, for clarity, a predeterminedly fixed, already installed stud may be thought of as a predecessor stud, and a loose stud to be installed may be thought of as a successor stud.

A further object of the present invention is to provide a novel process utilizing a speed hand tool of the type described above. As indicate above, this hand tool is intended to position what is in effect a successor stud with respect to what is in effect a predecessor stud. The predecessor stud is either the first stud to have been installed or another stud that has been installed after having been predeterminedly located with respect to the first stud. The hand tool is pressed downwardly by one hand until the cradle snugly fits about a successor stud, which is lying on the floor. Then the hand tool, together with that successor stud, is moved by that hand horizontally and angularly until the shoulder snugly fits against a predecessor stud, which has been secured into the structural module being created. The effective surfaces of the cradle and shoulder are configured to rest in a stable manner on surfaces of the studs that they snugly contact. Then, the successor stud is held in position by the tool under the control of one hand, while a nail gun is positioned and fired under the control of the other hand. Alternately, a hammer under the control of the other hand is used to nail the successor stud into fixed position. The arrangement is such that the hand holding the tool at one face of a footer or header is at a safe distance from the nail gun being held and aimed by the other hand.

Other objects of the present invention will in part be obvious and will in part appear hereinafter.

BRIEF DESCRIPTION OF THE DRAWINGS

For a fuller understanding of the nature and objects of the present invention, reference is made to the following specification which is to be taken in connection with the accompanying drawings wherein:

FIG. 1 is a perspective view illustrating the use of the tool of the present invention for moving a free stud on the floor, without lifting the stud or either of its ends from the floor, in accordance with the present invention;

FIG. 2 illustrates the free stud of FIG. 1 after it has been located a standard distance from a fixed stud prior to firing a nail from a nail gun through a header into its end;

FIG. 6 is a cross-sectional view, taken along the line 6–6 of FIG. 4;

FIG. 7 is a cross-sectional view, taken along the line 7—7 of FIG. 4;

FIG. 8 is a cross-sectional view, taken along the line 8—8 of FIG. 4;

FIG. 9 is a top plan view of another tool of the present invention;

FIG. 10 is a side elevation of the tool of FIG. 9;

DETAILED DESCRIPTION OF PREFERRED EMBODIMENTS OF THE PRESENT INVENTION

Figure 3:
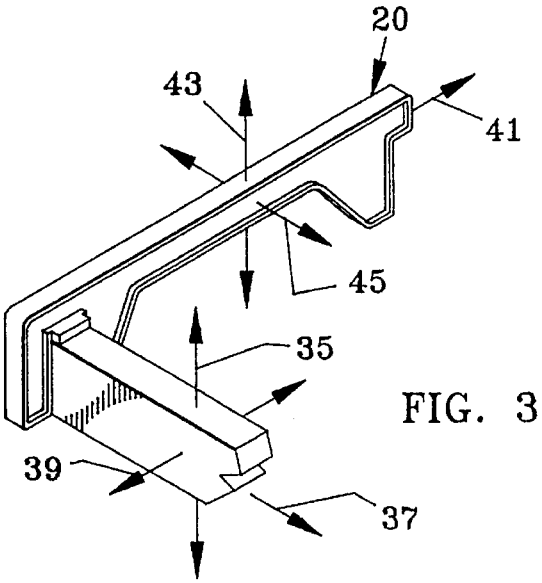
FIG. 3 illustrates certain technical principles of the present invention.
Figure 4:
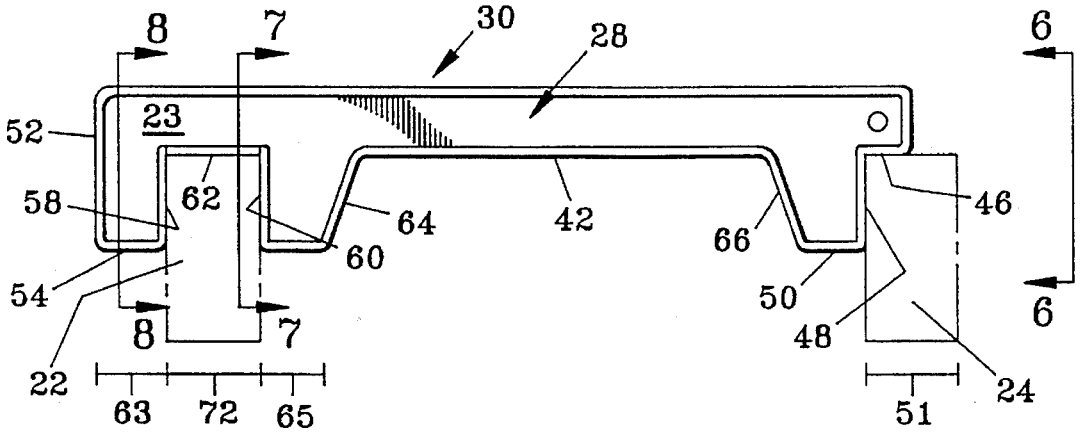
FIG. 4 is a side elevation of the tool of FIGS. 1 to 3.
Figure 5:
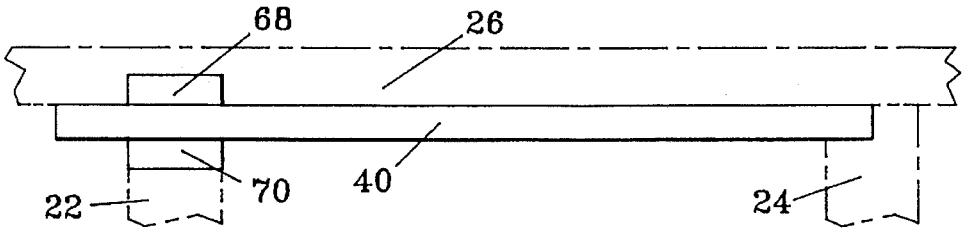
FIG. 5 is a top view of the tool of FIG. 4, in association with top phantom views of studs to which it is being applied.

The Integral Tool of FIGS. 1 to 8

FIGS. 1 to 8 illustrate a preferred tool 20, which comprises an elongated body member 21 that can serve as a handle, and a pair of cooperative members at the tool's opposite ends in the form of a cradle 23 and a shoulder 25. The cradle 23 is freely accessible to a loose or stud 22 only perpendicularly to or transversely of the tool's 20 axis of elongation, but not longitudinally of the tool's 20 axis of elongation. The shoulder 25 is freely accessible to a set stud 24 longitudinally of the tool's 20 axis of elongation. The arrangement is such that the cradle 23 can be snugly fitted about three faces of a loose stud 22 for translation and orientation along a plane, and the shoulder can be moved freely and snugly fitted against two faces of a set stud 24 to control the final position of the loose stud with respect to headers and footers, one of which is shown at 26. In this position, the loose stud 22 under the control of one hand 27, can be nailed into fixed position by a nail gun 29, which is held by the other hand 31. The procedure is performed on the horizontal floor 33 to form a structural module which can be lifted into an upright or angular position for installation as part of the framework of a house or other building. Ordinarily, the various orthogonal and traversal elements, which are rectangular in cross-sectional profile, are composed of either wood or galvanized steel configured into elements of like cross-sectional profile.

As shown in FIG. 3, the three rotational axes of the illustrated tool and the three rotational axes of the free stud are specifically related. The tool 20 is designed to enable a user to translate the loose stud 22 along the floor 33 with one hand as well as: (1) to swivel the stud about its vertical or yaw axis 35; (2) to rock the stud about its longitudinal or roll axis 37; and (3) to avoid lifting one end of the stud (or even the whole stud) about its transverse or pitch axis 39. From the foregoing considerations, it follows that the tool 20, once its cradle 23 is fitted on the loose stud 22, is intended: (1) to avoid rocking about its longitudinal or roll axis 41 by which its cradle would lose its fit to the loose stud 22 and the surfaces of the shoulder 25 could not be fitted to the set stud 24; (2) to permit the user to swivel the tool about its vertical or yaw axis 43; and (3) to permit the user to lift the shoulder slightly only if necessary or convenient to permit the tool to pivot or move about its transverse or pitch axis 45 until the shoulder 25 is in snug contact with the set stud 24.

As shown in FIGS. 4 to 8, the tool 20 is a plastic or aluminum casting, the members of which integrally incorporate an inner portion 28 and an outer perimeter portion 30. These portions extend throughout the elongated body member 21, the cradle 23 and the shoulder 25. The specific longitudinal and transverse spatial relationships among the elongated body member 21, the cradle 23 and the shoulder 25, the specific cross-sectional relationships between the inner portion 28 and the perimeter portion 30, and the specific profile of the tool 20 as a whole contribute to its proper operation.

It is preferred that the perimeter portion 30 is a peripheral flange that extends perpendicularly outwardly in both directions with respect to the inner portion 28 and that the inner portion 28 is a plate. In the elongated body member 21, the perimeter of the tool 20 is characterized by a horizontal upper planar face 40 and a horizontal lower planar face 42, which are parallel and spaced apart.

In the shoulder 25, the perimeter portion 30 includes a short shoulder end face 44 of a length that is substantially the same as the distance between the upper planar face 40 and the lower planar face 42. Extending inwardly and at a right angle from the lower end of the shoulder end face 44 is a horizontal shoulder face 46 that is substantially aligned with the lower planar face 42 and that in length is substantially equal to about one half the thickness of the set stud 24. Extending downwardly from the inner end of the horizontal shoulder face 46 and at a right angle thereto is a vertical shoulder face 48 which is greater in length than is the horizontal shoulder face 46. Extending inwardly from the lower end of the vertical shoulder face 48 and at a right angle thereto is a shoulder bottom face 50, which is shown as being approximately equal in length to the shoulder end face 44, but which may vary with respect thereto in alternative embodiments. The vertical shoulder face 48 and the shoulder bottom face 50 jointly form a shoulder jaw 51.

In the cradle 23, the perimeter portion 30 is configured as follows. The perimeter portion 30 includes a cradle end face 52 which is substantially equal in length to the distance between the upper planar face 40 and the shoulder bottom face 50. Extending inwardly and at a right angle from the lower end of the cradle end face 52 are a pair of aligned spaced apart cradle bottom faces 54 and 56. These planar faces are separated by a pair of vertical cradle faces 58 and 60 which are of substantially the same length as vertical shoulder face 48 and which are joined by a horizontal cradle face 62. The horizontal cradle face 62 is aligned with and approximately twice the length of the horizontal shoulder face 46. The first cradle bottom face 54 and the first vertical cradle face 58 are connected and jointly form a first jaw 63. Similarly, the second cradle bottom face 56 and the second vertical cradle face 60 are connected and jointly form a second jaw 65. The first jaw 63 and the second jaw 65, in combination with the horizontal cradle face 62 form a cradle mouth 72.

In a preferred embodiment, the horizontal cradle face 62 extends outwardly beyond the perimeter in both directions to provide ears 68 and 70 that ensure stability when one or the other rests on the header 26.

As shown, the shoulder bottom face 50 and the cradle bottom face 56 are joined to the lower planar face 42 by upwardly converging planar faces 64 and 66. The width of the perimeter portion 30 is sufficiently great for the tool to maintain stability when faces 50, 54 and 56 rest on the floor. The orientations and dimensions of and among planar adjoining faces 58, 60 and 62 are such as to snugly fit three faces of the loose stud 22. The orientations and dimensions of and between faces 46 and 48 are such as to snugly fit against two adjoining faces of the set stud 24. The ears 68, 70 are of the same thickness as the perimeter portion 30.

EXAMPLE

| | | |
|---|---|---|
| (1) | Thickness of the inner portion 28 and perimeter portion 30 | 3/16 inch |
| (2) | Distance between faces 44 and 52 | 18 5/16 inches |
| (3) | Distance between shoulder end face 44 and midway between vertical cradle faces 58 and 60 | 16 inches |
| (4) | Distance between upper planar face 40 and faces 50, 54 and 56 | 3½ inches |
| (5) | Distance between upper planar face 40 and lower planar face 42 | 1½ inches |
| (6) | The overall width of the flanged perimeter portion 30 | ¾ inch |
| (7) | Distance between vertical cradle faces 58 and 60 | 1⅝ inches |

The illustrated tool is cast from high density polyethylene and is designated to set 2×4, 2×6, 2×8, 2×10, and 2×12, inch wooden or aluminum studs at 16 inch centers.

The Adjustable Tool of FIGS. 9 and 10

FIGS. 9 and 10 illustrate an adjustable tool 80, in accordance with the present invention, for assembling studs, joists, rafters and like orthogonal elements, which may be of 10 different selected thicknesses and at different selected distances apart, between headers, footers, plates and like traversal elements in a framing procedure. The tool comprises an elongated body member 82 that can serve as a handle, and a pair of conjunctive members in the form of a cradle 84 and a shoulder 86 at its opposite ends.

The positions and distance between the jaws of the cradle 84 are adjustable with respect to the elongated body member 82. The position of the shoulder 86 is adjustable with respect to the elongated body member 82. The cradle 84 is freely accessible to a loose or uninstalled stud only perpendicularly to or transversely to the tool's 80 axis of elongation, but not longitudinally of the tool's 80 axis of elongation. The shoulder 86 is freely accessible to a set or installed stud longitudinally of the tool's 80 axis of elongation. The arrangement is such that the cradle 84 can be snugly fitted about three faces of a loose stud of arbitrary dimensions for translation and orientation along a plane, and the shoulder 86 can be moved freely and snugly fitted against two faces of a set stud that is an arbitrary distance therefrom to control the final position of the loose stud with respect to headers and footers.

As shown in FIGS. 9 and 10 the elongated body member 82 is a plastic or aluminum casting having parallel upper and lower planar faces 88 and 90, and parallel side faces 92 and 94.

In the vicinity of the cradle 84, the elongated body member 82 has an elongated cradle slot 96 that opens upwardly at the upper planar face 88 and downwardly at the lower planar face 90. At the upper planar face 88, the elongated cradle slot 96 is surrounded by an upper cradle slot depression 98. At the lower planar face 90, the elongated cradle slot 96 is surrounded by a lower cradle slot depression 100.

At the lower planar face 90 are a pair of cradle aligned arms 101 that extend in opposite directions along the lower planar face 90 and a pair of cradle perpendicular arms 103 that project downwardly from the lower planar face 90 and cooperate with the lower planar face 90 to form a cradle. The cradle aligned arms 101 ride on the lower planar face 90 and are constrained by cradle keys 106 and 108, which are integral with and project upwardly from the cradle aligned arms 101 into the lower cradle slot depression 100. The cradle perpendicular arms 103 constitute jaws. One cradle aligned arm 101 attaches to one cradle perpendicular arm 103 forming cradle brackets 102, 104. Cradle brackets 102 and 104 are adjustably fixed with respect to the elongated body member 82 by a pair of elongated bolts 110, 112, which project through the elongated cradle slot 96 and are turned by wing heads into nuts 113 which are retained within the upper cradle slot depression 98.

In the vicinity of the shoulder 86, the elongated body member 82 has an elongated shoulder slot 114 that opens upwardly at the upper planar face 88 and downwardly at the lower planar face 90. At the upper planar face 88, the elongated shoulder slot 114 is surrounded by an upper shoulder slot depression 116. At the lower planar face 90, the elongated shoulder slot 114 is surrounded by a lower shoulder slot depression 118.

At the lower planar face 90 also is an L-shaped shoulder bracket 120 which has a shoulder perpendicular arm 121 that projects downwardly and cooperates with the lower planar face 90 to provide the shoulder 86. The shoulder bracket 120 also has a shoulder aligned arm 123 that rides on the lower planar face 90. Integral with the shoulder aligned arm 123 is a shoulder bracket key 122 that projects into the lower shoulder slot depression 118. The shoulder bracket 120 is adjustably fixed with respect to the elongated body member 82 by an elongated bolt 124, which projects through the elongated shoulder slot 114 and is turned by a wing head into a nut 125 that is retained within the upper shoulder slot depression 116.

OPERATION

Each of the illustrated tools is particularly designed for setting 2×3's, 2×4's, 2×6's, 2×8's, 2×10's, and 2×12's, i.e. studs, joists and rafters having nominal cross sectional dimensions of 2×3, 2×4, 2×6, 2×8, 2×10, and 2×12 inches, respectively. For convenience, these dimensions are referred to generally as 2×X inches. In practice, for example, a succession of 2×3's or 2×4's are laid out on the floor, and a first stud, joist or rafter, i.e. a predecessor orthogonal element is nailed between a header and footer pair at right angles thereto. Thereafter, the cradle of the tool is seated on a successor orthogonal element, and the associated tool and length of stock are positioned in such a way that the shoulder snugly fits against the predecessor orthogonal element. The process then is continued until an entire module is framed.

The arrangement is such that, when the loose stud is held in position by one hand with the aid of the tool the nail gun is fired by the other hand. The nail gun, when held by one hand, is displaced a safe distance away from the tool which is under the control of the other hand. It will be observed that the user, during this operation is a safe distance rearwardly of the nail gun. The interaction between the cradle and the shoulder is critical. The cradle can be readily pressed onto or removed from any stud because there is only one snug fit that is involved. The shoulder, which does not involve a snug fit at the opposite side of a stud, does not impede the fitting process. It will be appreciated that contending with one snug fit is much easier that contending with two snug fits simultaneously. The reason for this is that a slight rocking motion may be required, particularly during removal of the tool from one construction element. However, if two construction elements were seated in two cradles simultaneously, the rocking motion necessary for removal from one construction element would impede removal from the other.

What is claimed is:

1. A tool (20) for spacing and manipulating studs while installing between header and footer (26), the studs having a width W and spaced at a predetermined distance D, the tool (20) comprising:

an elongated body member (21) having a first end, a second end and an axis of elongation;

a cradle (23) attaching to said first end of said elongated body member (21) having, a first jaw (63) spaced apart from a second jaw (65) by a distance sufficient to accommodate the stud of width W, said first jaw (63) and said second jaw (65) having a horizontal cradle face (62) therebetween, said first jaw (63) and said second jaw (65) being positioned substantially normal to said axis of elongation;

a shoulder (25) attaching to said second end of said elongated body member (21) and spaced apart from said second jaw (65) by the predetermined distance D, said shoulder (25) having, a shoulder jaw (51) and a horizontal shoulder face (46), said shoulder jaw (51) being spaced apart from said first jaw (63) and said second jaw (65) and being substantially normal to said axis of elongation; and further wherein said first jaw (63), said second jaw (65) and said shoulder jaw (51) each have a perimeter portion (30) said perimeter portions (30) lying in a common plane thereby allowing said cradle (23) and said shoulder (25) to abut either the header or the footer (26).

2. The tool (20) of claim 1 wherein said elongated body member (21) further comprises:

an upper planar face (40) and a lower planar face (42) which are substantially parallel to said axis of elongation;

said lower planar face (40), said horizontal craddle face (62) and said horizontal (46) being coplanar.

3. The tool (20) of claim 2 wherein said elongated body member (21), said first jaw (63), said second jaw (65), and said shoulder jaw (51) have an inner portion (28) which is a plate and further wherein said perimeter portion (30) is a flange which is substantially normal to said plate forming said inner portion (28).

4. The tool (20) of claim 2 further comprising:

ears (68,70) attaching to said horizontal cradle face (62) and extending said horizontal cradle face.

5. The tool (20) of claim 3 further comprising:

ears (68,70) attaching to said horizontal cradle face (62) and extending said horizontal cradle face.

6. The tool (20) of claim 2 wherein said horizontal shoulder face (46) has a length approximately half of the stud width W.

7. The tool (20) of claim 3 wherein said horizontal shoulder face (46) has a length approximately half of the stud width W.

8. The tool (20) of claim 4 wherein said horizontal shoulder face (46) has a length approximately half of the stud width W.

9. The tool (20) of claim 5 wherein said horizontal shoulder face (46) has a length approximately half of the stud width W.

10. An adjustable tool (80) for spacing and installing studs between a header and footer, the studs having a width W, and spaced at a specified distance D, the adjustable tool (80) comprising:

an elongated body member (82) having an upper planar face (88), a lower planar face (90) and a longitudinal axis terminating in a cradle (84) and a shoulder (86);

said cradle (84) further having:

an elongated cradle slot (96), a first cradle bracket (102) and a second cradle bracket (104) each of said cradle brackets (102,104) having a cradle aligned arm (101) and a cradle perpendicular arm (103), and a pair of elongated bolts (110,112) and nuts (113) each of said bolts (110) slidably engaging said elongated cradle slot (96) and engaging one of said cradle aligned arms (101) of one of said cradle brackets (102, 104) and fastening to one of said nuts (113), said elongated cradle slot (96) being configured to allow said pair of elongated bolts (110,112) to be maintained at a separation such that said first cradle bracket (102) and said second cradle bracket (104) can be maintained at a distance sufficient to accommodate the stud of width W;

said shoulder (86) further having:

an elongated shoulder slot (114), a shoulder bracket (120) having a shoulder aligned arm (123) and a shoulder perpendicular arm (121), and an elongated bolt (124) and nut (125) said bolt slidably engaging said elongated shoulder slot (114) and engaging said shoulder aligned arm (123) of said shoulder bracket (120) and fastening to said nut (125), said elongated shoulder slot (114) being so positioned with respect to said elongated cradle slot (96) that said shoulder bracket (120) can be maintained spaced apart from said second cradle bracket (104) by the specified distance D; and said first bracket (102), said second bracket (104) and said shoulder bracket (120) being so positioned to allow said cradle (84) and said shoulder (86) to abut either the header or the footer.

11. The tool (80) of claim 10 further comprising:

an upper cradle slot depression (98) in said upper planar face (88) of said elongated body member (82) said upper cradle slot depressions (98) communicating with said elongated cradle slot (96); and an upper shoulder slot depression (116) in said upper planar face (88) of said elongated body member (82) said upper shoulder slot depressions (116) communicating with said elongated shoulder slot (114);

said upper cradle slot depression (98) and said upper shoulder slot depression (116) being configured to hold said nuts.

12. The tool (80) of claims 10 further comprising:

a lower cradle slot depression (100) in said lower planar face (90) of said elongated body member (82) said lower cradle slot depression (100) communicating with said elongated cradle slot (96);

cradle keys (106) attaching to said cradle aligned arms (101) and engaging said lower cradle slot depression 100;

a lower shoulder slot depression (118) in said lower planar face (90) of said elongated body member (82) said lower shoulder slot depression (118) communicating with said elongated shoulder slot (114); and a shoulder key (122) attaching to said shoulder aligned arm (123) and engaging said lower shoulder slot depression (118).

13. The tool (80) of claim 11 further comprising:

a lower cradle slot depression (100) in said lower planar face (90) of said elongated body member (82) said lower cradle slot depression (100) communicating with said elongated cradle slot (96);

cradle keys (106) attaching to said cradle aligned arms (101) and engaging said lower cradle slot depression (100);

a lower shoulder slot depression (118) in said lower planar face (90) of said elongated body member (82) said lower shoulder slot depressions (118) communicating with said elongated shoulder slot (114); and a shoulder (key) 122 attaching to said shoulder aligned arm (123) and engaging said lower shoulder slot depression (118).

14. An adjustable tool (80) for spacing and installing studs between a header and a footer said studs having a width W, and spaced apart at a specified distance D, the adjustable tool (80) comprising:

an elongated body member (82) and a longitudinal axis terminating in a cradle (84) having a first cradle bracket (102) and a second cradle bracket (104), each of said cradle brackets (102,104) having a cradle perpendicular arm (103) which is perpendicular to said longitudinal axis; and a shoulder (86) having a shoulder perpendicular arm (121) which is perpendicular to said longitudinal axis, said shoulder (86) being adjustably engaged on said elongated body member and adjustable with respect to said cradle (84)to provide the specified separation distance D.

15. The adjustable tool (80) of claim 14 wherein said first cradle bracket (102) and said second cradle bracket (104) adjustably engage said elongated member to provided a separation the width W.

16. The adjustable tool (80) of claim 14 wherein said shoulder slidably engages said elongated body member.

17. The adjustable tool (80) of claim 16 wherein said cradle and said shoulder slidably engage said elongated body member.

18. The adjustable tool (80) of claim 17 wherein said cradle and said shoulder (86) are positioned to allow said cradle and said shoulder to abut either the header or the footer.

* * * * *